United States Patent [19]

Dickinson, III et al.

[11] Patent Number: 4,527,639

[45] Date of Patent: Jul. 9, 1985

[54] HYDRAULIC PISTON-EFFECT METHOD AND APPARATUS FOR FORMING A BORE HOLE

[75] Inventors: Ben W. O. Dickinson, III, San Francisco; Robert W. Dickinson, San Rafael; Stanley O. Hutchison, Bakersfield, all of Calif.

[73] Assignee: Bechtel National Corp., San Francisco, Calif.

[21] Appl. No.: 471,437

[22] Filed: Mar. 2, 1983

Related U.S. Application Data

[63] Continuation-in-part of Ser. No. 401,613, Jul. 26, 1982, abandoned.

[51] Int. Cl.[3] ..... E21B 7/06; E21B 7/18

[52] U.S. Cl. ..... 175/61; 175/65; 175/67; 175/77; 175/78; 175/80; 166/50

[58] Field of Search ..... 175/61, 62, 67, 75, 175/77, 78, 79, 80, 81, 82, 83, 94, 65; 166/77, 384, 50, 383

[56] References Cited

U.S. PATENT DOCUMENTS

| | | | |
|---|---|---|---|
| 789,324 | 5/1905 | Jubb | 175/67 |
| 1,367,042 | 2/1921 | Granville | 175/62 |
| 2,538,545 | 1/1951 | Whitehead et al. | 175/80 |
| 3,191,697 | 6/1965 | Haines | 175/422 |
| 3,200,882 | 8/1965 | Allen | 166/155 |
| 3,373,818 | 3/1968 | Rike et al. | 166/77 |
| 3,467,211 | 9/1969 | Goodwin et al. | 175/422 |
| 3,640,344 | 2/1972 | Brandon | 175/67 |
| 3,873,156 | 3/1975 | Jacoby | 175/61 |
| 3,901,811 | 8/1975 | Finch | 166/105 |
| 4,031,971 | 6/1977 | Miller | 175/422 |
| 4,201,074 | 5/1980 | Cox | 166/356 |

FOREIGN PATENT DOCUMENTS

| | | | |
|---|---|---|---|
| 470584 | 8/1975 | U.S.S.R. | 175/62 |
| 747985 | 7/1980 | U.S.S.R. | 175/75 |
| 781325 | 11/1980 | U.S.S.R. | 166/298 |

*Primary Examiner*—James A. Leppink
*Assistant Examiner*—Hoang C. Dang
*Attorney, Agent, or Firm*—Flehr, Hohbach, Test, Albritton & Herbert

[57] ABSTRACT

A system for the formation of a bore hole, particularly for use in enhancing the recovery of oil from an oil bearing underground formation using an assembly including a piston sliding in a guide tube. The forward end of the piston body terminates in a drillhead including multiple ports for passing drilling fluid into the formation. Pressurized fluid flowing through the piston body applies pressure against the drillhead to cause it to move into the formation at the same time as it is cutting a pathway for itself. In a preferred embodiment, the forward end of the guide tube includes a whipstock through which the piston body turns from a vertical to a horizontal direction into the formation to provide a radial for the injection of steam. A rigid metal piston body may be used which plastically deforms when passing through the whipstock and becomes rigid thereafter as it moves through the formation.

61 Claims, 26 Drawing Figures

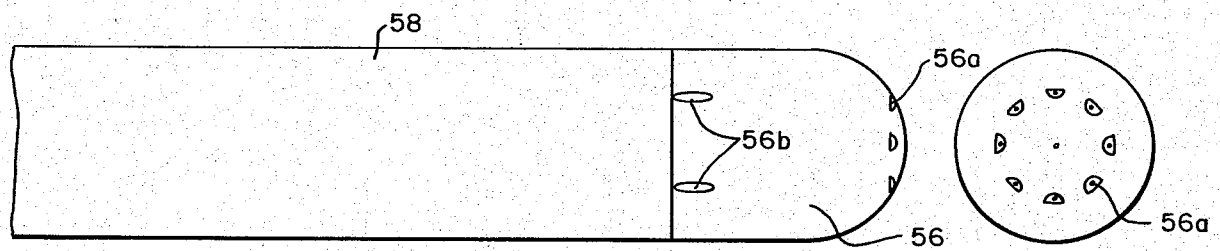
FIG.—3
FIG.—4
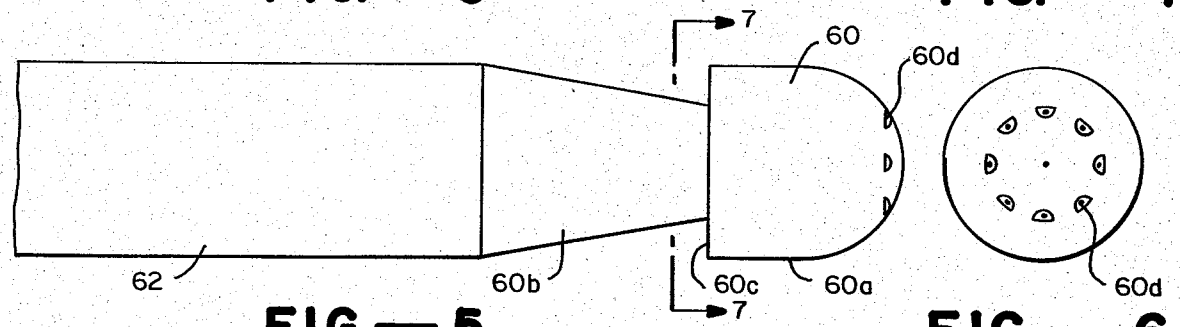
FIG.—5
FIG.—6
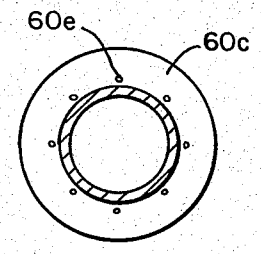
FIG.—7
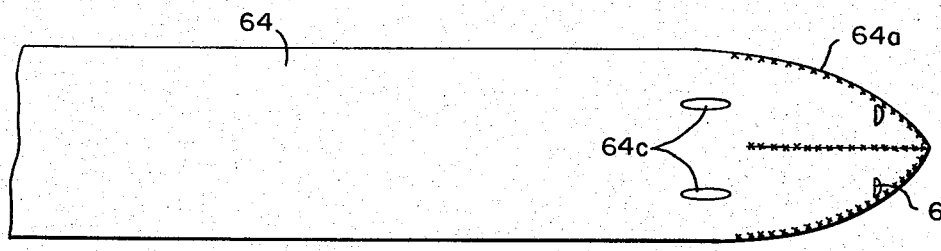
FIG.—8
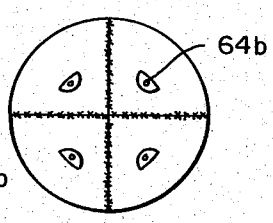
FIG.—9

HYDRAULIC PISTON-EFFECT METHOD AND APPARATUS FOR FORMING A BORE HOLE

This application is a continuation-in-part of co-pending application Ser. No. 401,613 filed July 26, 1982 now abandoned.

This invention relates generally to earth well drilling apparatus and methods. Particularly it relates to apparatus and methods applicable to drilling one or more bores extending laterally from a lower region of a well into a mineral bearing formation.

A conventional drill hole for producing oil from an oil-bearing formation is formed by drilling with a rotary bit driven by a rotating drill pipe which extends through the central opening of a well. A drilling fluid is passed centrally through the drill pipe to remove the cuttings in the excavated area ahead of the bit to form a slurry which is pumped to the surface in an annular space formed between the drill pipe and adjacent earth formation. After drilling, a casing is placed into the bore hole and cemented to the formation.

There are a number of disadvantages in the use of the foregoing technique. Firstly, it is expensive to drill into the earth with a rotating drill system at extended depths. Secondly, it is difficult to change the direction of the drilling from vertical to horizontal, as would be desirable for efficient production of petroleum in some situations. Thirdly, the rotation of the drill pipe to which the bit is attached within the casing creates great friction, power loss, and wear of both drill pipe and casing.

By the use of known whipstock devices and techniques, a bore hole may be directed laterally from the vertical. However, transition from a vertical to a horizontal bore hole presents difficulties, particularly when a small turning radius is desired (e.g. less than a ten foot radius) to permit injection of steam, solvents or other fluids into the formation for enhanced recovery of minerals. This capability is particularly desirable for heavy (high viscosity) oil-bearing formations.

A number of techniques have been attempted to form lateral or radial (essentially horizontal) bore holes from a vertical, cased bore hole. In one technique, an oversized vertical bore hole is formed of sufficiently large diameter such that miners may descend to a location near the bottom of the hole, from which they can drill horizontal by conventional means. This technique is both costly and dangerous, particularly at great depths. In another approach, a technique known as drain-hole drilling is employed. Here, a vertical bore hole is bored with rotary equipment in a conventional way. A special assembly is attached near the lower end of the drill column, including a pre-formed, non-rotating, curved guide tube known as a whipstock, and an inner, flexibly jointed, rotatable drive pipe. Then, the drill passes along the curved assembly in a generally lateral direction to drill a lateral. A variety of such systems are set forth in the following U.S. Pat. Nos. Zublin 2,669,429, Feb. 16, 1954; McCune et al. 2,797,893, July 2, 1957; and Holbert 3,398,804, Aug. 27, 1968. Multiple whipstocks for directing drill pipes at oblique angles are suggested in Owsley et al., U.S. Pat. No. 3,330,349, July 11, 1962. All of these systems are subject to the disadvantage that there is a high frictional relationship between the curved, flexibly jointed drill pipe and the adjacent formation, and it is difficult to form truly horizontal bore holes; instead, downwardly directed bore holes with relatively large turning radii are formed. In some instances horizontal bore holes have been drilled, but with the use of whipstock means which applies a relatively large radius turn or bend. In addition, such bore holes are costly to drill and directional control is erratic. Another disadvantage is that the deflected rotating drill pipe tends to wear out quickly due to continuous frictional contact with the formation. In addition, the friction between the deflected rotating drill pipe and the formation limits the extent to which the drill can penetrate the formation before being stopped.

A variant of the drain-hole principle for subterranean boring is disclosed in Grebe U.S. Pat. No. 2,271,005, Jan. 23, 1939. There, a flexible drilling conduit terminating in an elongate bullet-shaped hydraulic drillhead with multiple ports passes through a curved guide tube. A hydraulic fluid, such as acid solution, is pumped through the conduit from the surface of the well and discharged from the drilling head to form a radically directed bore as the drilling head is advanced. A complex system is disclosed for driving the conduit incrementally forward by the application of force thereto and by periodic inflation and deflation of inflatable packers spaced in the conduit. The resulting discontinuous creeping movement of the conduit is analogous to that of an earth worm.

A system somewhat similar to the aforementioned Grebe patent is disclosed in Chamberlain, U.S. Pat. No. 2,258,001, Oct. 7, 1944. There too, a flexible drilling conduit is utilized which terminates in a bullet-shaped nozzle with multiple ports. An acid is discharged from the drillhead to cut through the formation. Advancing movement of the drillhead into the formation is controlled by means at the top of the well which counterbalances the weight of the conduit. There is no indication how the systems of Grebe or Chamberlain could maintain a precise horizontal direction in view of the flexibility of the pipe.

Other patents disclose radials without precise information as to the mode of producing the radials in the formation. For example, Anderson et al., U.S. Pat. No. 3,994,340, Nov. 30, 1976 discloses a radial for the injection of steam into the viscous petroleum formation with a production well adjacent one end of the formation.

In Pisio et al., U.S. Pat. No. 4,020,901 May 3, 1977, a complex arrangement is disclosed which suggests that steam injection and production could be accomplished in a single well. There are no details disclosed regarding the well casing. However, it is of such a large size that it appears the technique is such that miners descend to a location near the bottom of the well to drill horizontal holes.

SUMMARY OF THE INVENTION AND OBJECTS

The present invention is directed primarily to a system for the formation of a bore hole for use in the recovery or enhancement of recovery of oil from an oil-bearing formation, or for the recovery of mineral deposits or the like, or for drilling through an underground formation for some other purpose. The system includes an assembly with piston means in a guide means. The piston means consists of a body formed by a drilling tube which is open at its rearward end and includes a drillhead of the hydraulic jet type at its forward end, the drillhead being provided with multiple fluid exit ports. The guide means is a tube or pipe fluid communication with the interior of the drilling pipe. There is sealing means between the drilling tube and guide pipe so that pressurized fluid flowing through the guide tube and drilling tube applies force to cause the piston means to move in a forward direction through tube bending means and into the underground formation. A seal is provided between the drilling tube and the guide tube.

In a preferred embodiment, the bending means or whipstock is attached to the guide pipe to cause the piston body or drilling tube to turn from the vertical to the generally horizontal direction in a short radius of the order of 6 to 12 inches for steel drilling tubes that may, for example, be of the order of $1\frac{1}{4}$ to $1\frac{1}{2}$ inches OD, with a wall thickness of from 0.080–0.125 inches. Such a normally rigid metal piston body, due to the hoop stress caused by internal high pressure drilling fluid and the bending stress during movement through the whipstock, causes plastic deformation in the metal during the turn without collapse or breaking of the tube. Thereafter straightening means causes the tube to reassume a substantially straight condition.

Two or more such assemblies may be provided in a well to provide two or more laterally extending bores for the injection of a hot fluid, such as steam, to heat oil in the formation and cause it to flow to a nearby production well or to a production pump in the same well casing.

Objects of the invention include the providing of a system and method that is capable of forming radially extending bores (radials) in a relatively short radius turn, and which is efficient and economical compared to prior systems and methods.

It is a particular object to form multiple radials in a single pre-existing well casing.

It is a further object to provide a multiple radial system in a combined injection production well.

It is a further object to provide a system of the foregoing type capable of drilling into unconsolidated formation without the necessity of using a rotating drillhead.

Further objects and features of the invention will be apparent from the following description taken in conjunction with the appendant drawings.

BRIEF DESCRIPTION OF THE DRAWINGS

FIGS. 3 and 4 are side and end views, respectively, of a drillhead and piston body.

FIG. 5 is a side view, FIG. 6 an end view, and FIG. 7 a cross-sectional view, taken along line 7—7, of another embodiment of a drill head-piston body in accordance with the invention.

FIGS. 8 and 9 are a side view and end view, respectively, of a third embodiment of the drill head-piston body according to the invention.

FIG. 10 is a sectional view illustrating a drillhead and a single opening, while

In one major use of the present invention, a system is provided for forming one or more radial pipes or tubes in radial bores extending from a pre-existing cased well. A major use for such a radial pipe is to inject a hot fluid such as steam or solvents into the surrounding formation to render high-viscosity oil in the underground formation more flowable. An important application is to heat oil left in the ground by a production well system which has ceased producing economically.

Figure 1:
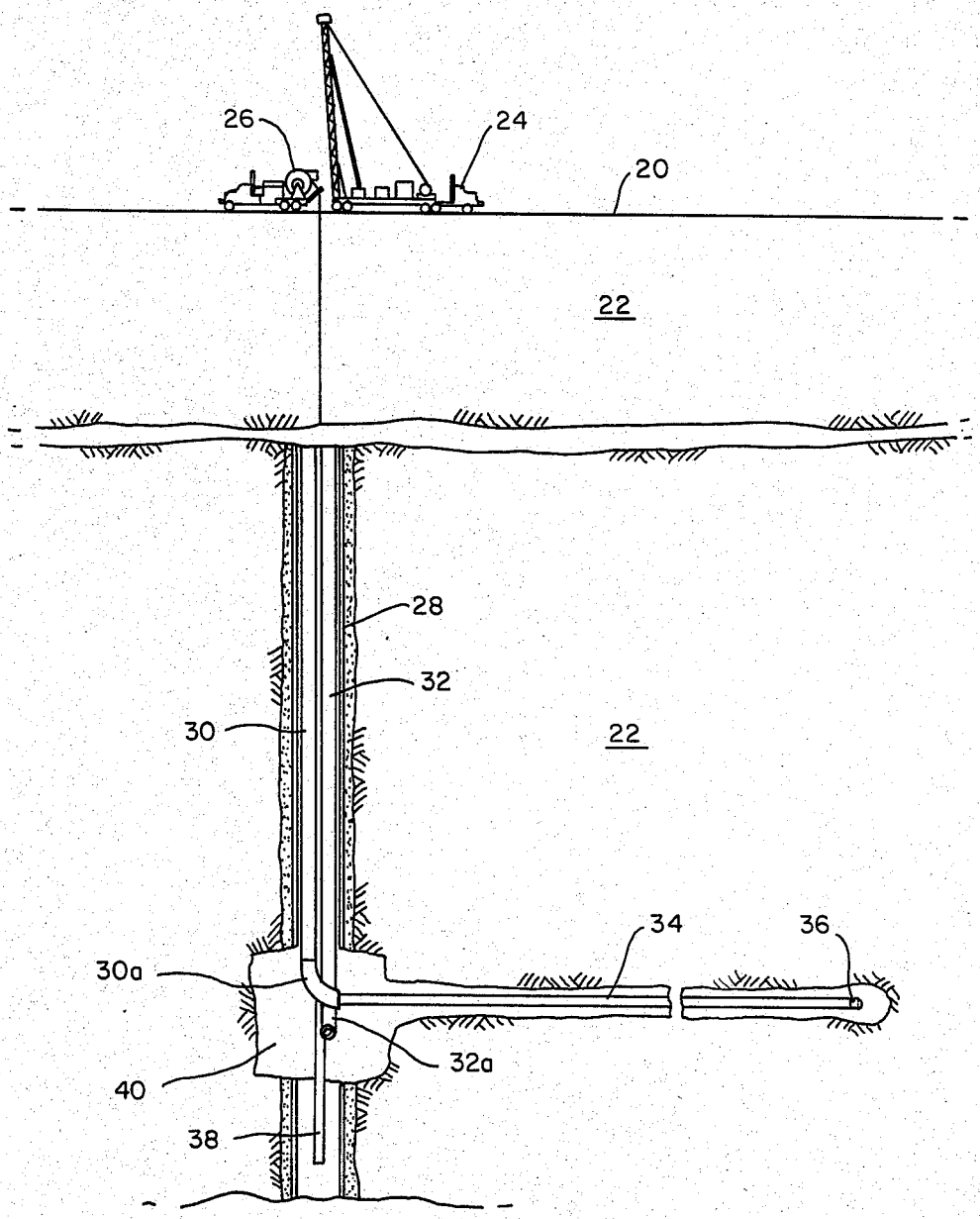
FIG. 1 is a side elevational view, partially in section, illustrating a drill string assembly with conventional surface apparatus, and an expanded, partially broken away well casing and radials formed in accordance with the invention.

Referring to FIG. 1, the ground level 20 above the underground mineral bearing formation 22 is illustrated on which a production rig is disposed to the right and coiled tubing rig 26 is disposed to the left. The function of a production rig 24 is to screw together sections of one or more guide tubes or pipes 30 and 32 at the site in a conventional manner. Piston body or drilling tube 34 is formed of a metal tube of the solid wall type which may for example have an outer diameter (OD) of approximately 1.25 in., and is coiled on spool 26 and passed downwardly into the guide tube. When a sufficient length of the piston body or drilling tube 34 is in the guide pipe to reach the desired ultimate radial length, the drilling tube is severed and lowered down the guide pipe.

The lower portion of the drawing illustrates a pre-existing cemented-in well casing 28 in which are contained two different axially disposed guide pipe means, including axially disposed guide tubes or pipes 30 and 32, terminating in whipstocks **30*a* and 32*a*, respectively, each whipstock having curved barrels or guideways. Piston means are disposed in each guide pipe, each piston means including an elongate piston body in the form of a drilling tube, the tube terminating in drillhead means. The piston body is formed of a relatively rigid metal material such as steel, and so has the advantage of moving in a substantially straight path through the formation. As illustrated, only piston body or drilling tube 34, traveling in guide pipe 30, is visible with drillhead means 36** at the forward end thereof. A suitable guide pipe is about 2 in. OD in about 30 ft. sections.

The piston body or drilling tube 34 can be turned by bending and, upon turning through whipstock 30*a* and drilling into the formation, becomes a radial or lateral tube or duct suitable for the injection of a hot fluid such as steam into the formation to heat up the viscous oil for removal. In the alternative, heat from the hot fluid causes the oil to flow back towards a casing containing a production pump as well as the radial, as better illustrated in FIG. 14 described below.

In the illustrated embodiment, a fluid downcomer 38 (e.g. 1.25 in. OD) projects centrally of guide tubes 30 and 32 and is suitable for the injection of a foamed or foamable fluid to assist the lifting of cuttings formed during operation of the drillhead 36, or during subsequent deposition of cement. Such cuttings flow back along the tube 34 and are lifted by foam to flow upwardly through axial spaces within the well casing 28. Tube 38 may also be used to conduct and deposit cement into chamber 40 to fix the position of the radials and whipstocks upon completion of vertical bore hole drilling.

In a typical operation, well casing 28 may be present from a pre-established injection well. A typical size in some areas of the United States for such casing is 5½ in. in outer diameter, although larger casings may be used. Normally, the casing has been milled and the formation underreamed in a conventional manner to form a cavity 40 within which the whipstock 30*a* is disposed. In an alternative described more fully below, an abrasive such as silica may be added to the drilling fluid supplied to drillhead 36 or a separate drilling device, and directed against an existing well casing wall or cement formation to bore an opening through the casing or formation so that the drilling tube 34 and head 36 can move through the wall or formation to form a radial.

The general principle of forming a radial according to the invention is now disclosed, although the detailed structure of the parts will be described more fully below in conjunction with the drawings. Briefly, the piston body or tube 34 is adapted to move within the guide pipe and provides an interior fluid passageway with an outward, open rearward end and drillhead means at its forward end. Multiple fluid exit ports are provided in the drillhead means for the passage of drilling fluid from the piston body fluid passageway into the adjacent formation. The interior of the guide pipe means is in fluid communication with the rearward end of the piston body interior passageway. Sealing means (84 of FIG. 12) provides a seal between the piston means and the guide tube. High pressure fluid flowing through the piston body fluid passageway applies pressure against the back of the drillhead means to cause the piston to move in a forward direction. When the piston body or tube reaches the whipstock, combined stresses, including the hoop stress (or radial stress) caused by the high pressure fluid within the piston body, together with the bending stress in the whipstock, causes the piston body or tube, which is a normally rigid metal, to be stressed and deformed plastically in a physical metallurgical sense and to bend and turn into a radial, preferably horizontal, direction so as to be movable into the formation. The high pressure liquid issuing from the drillhead drills out the formation and forms cuttings, which are slurrified and passed backwardly along the outside periphery of the piston body into cavity 40, wherein foam or other lifting fluid, which is passed downwardly through downcomer 38, lifts the slurry up to the surface of the formation through the axial space within the casing not otherwise occupied by the guide tubes. In an alternative, not shown, no fluid downcomer is required and the fluid is directed into the surrounding formation under such force that the formation fracs or fractures, causing fissures into which the formed slurry can flow, whereby little, if any, cuttings are moved rearwardly along the radial and so lifting of such cuttings is not required.

A significant advantage of this system is that it is capable of drilling radial bores with a non-rotating drillhead, and that the bore hole is cased while drilling.

Figure 2:
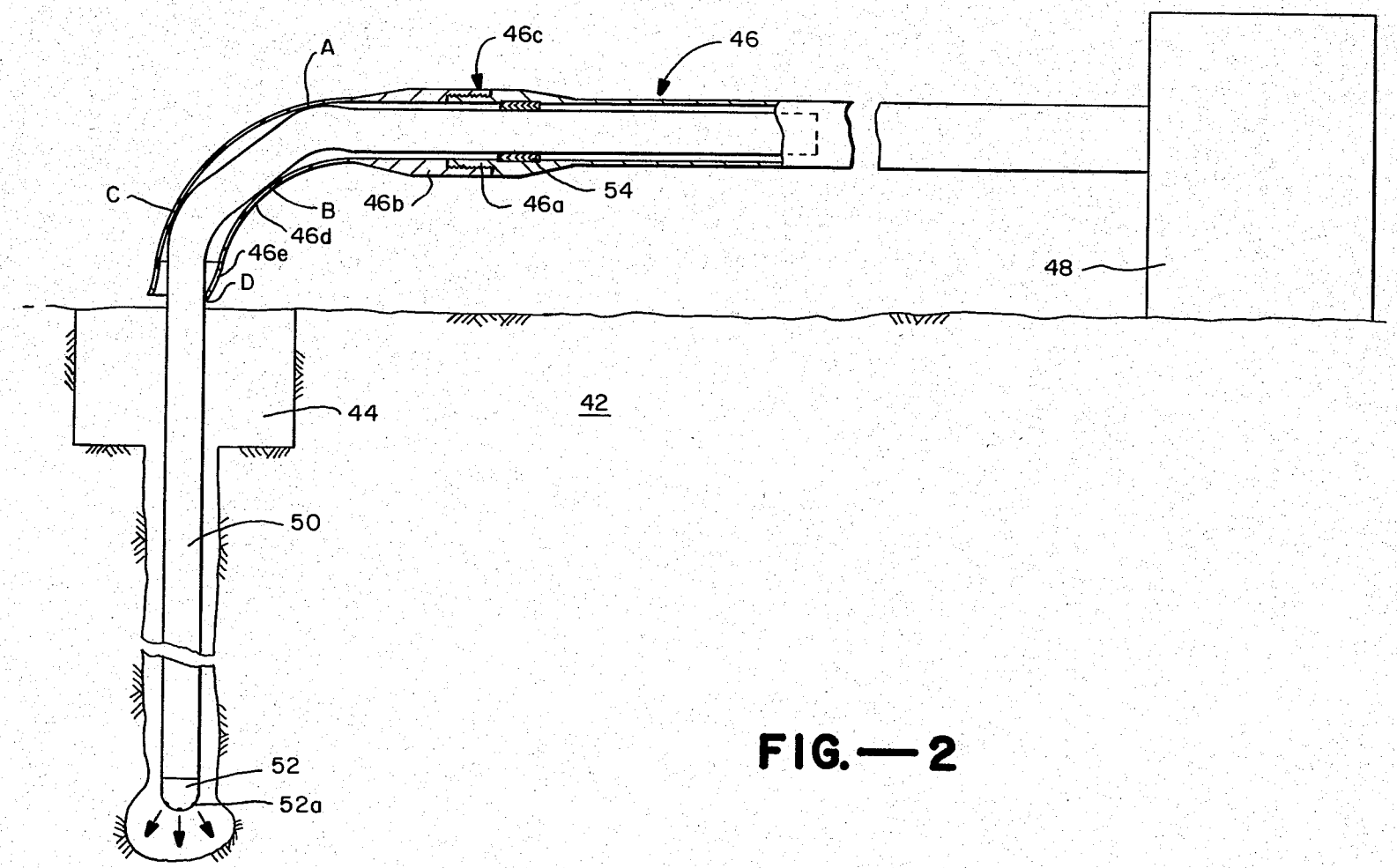
FIG. 2 is a schematic view, partially in section, of the assembly of the present invention moving horizontally through a whipstock and turning to a vertical direction.

Referring to FIG. 2, a system is illustrated for vertical hydraulic jet drilling. It utilizes the piston-guide pipe assembly of FIG. 1, in which the piston tube turns from a horizontal direction on the surface to a vertical direction by passage through a whipstock on the surface. This permits the guide pipe to extend along the ground rather than being supported vertically. The underground formation 42 includes an upper cavity 44 to facilitate drilling. A guide tube generally designated by the number 46 is formed in sections, with the threaded ended male member or pin 46*a* of one section being received within the female member or box 46*b* of the joined section, to form a joint designated 46*c*. Guide tube or pipe 46 is supported at ground level by conventional means. The rearward end of guide pipe 46 is illustrated as projecting into a housing 48, which includes a source of high pressure drilling fluid, not shown, and also means for introducing the piston means comprising piston or drilling tube 50 terminating in drillhead 52. A drilling fluid seal 54 is provided which may be of chevron type as illustrated. The forward end of guide pipe 46 is formed into a curved whipstock 46*d* attached by coupling 46*c* to the main body of the guide pipe. Whipstock 46*d* includes a curved barrel adapted to bend or turn the piston body 90° from a generally horizontal to a generally vertical direction. The drilling tube is introduced into the guide pipe 46 after some sections of this pipe have been assembled, the length of the tube being such that the portion on the pump side of the seal is sufficient to enable the drillhead to operate to the desired depth, without disengagement from seal 54.

In operation, piston or drilling tube 50 is urged forwardly away from the high pressure pump in housing 48 to the left as shown in the drawing, past seal 54, by the drilling fluid pressure applying force against the fluid pressure area of the rearward side of the drillhead. When the piston tube is forced through the whipstock 46*d*, bending forces are applied to cause the tube to conform generally to the curve of the whipstock, whereby the tube is caused to turn downwardly into the formation. A straightener portion 46*e* is provided at the forward end of whipstock 46*d*. It is inclined towards the vertical (e.g. at 5 to 10 degrees) in the same general direction as the forward movement of the tube. in this manner, the contact of the tube with the pipe straightener at point D causes the pipe to straighten into a generally vertical direction, rather than to continue its curve and curl backwardly into a spiral path. Drilling fluid is directed outwardly through ports 52*a* of the drillhead 52 into the formation to provide a slurry through which the drillhead readily moves under the force applied by the pressurized fluid.

The piston body or tube may be formed of steel or other metal of sufficient rigidity to travel in a straight line through the formation, but is capable of the above plastic deformation. For example, a suitable wall thickness for this purpose is 0.080–0.125 in. of 36,000–70,000 psi or more yield steel for tubes ranging from $1\frac{1}{4}$ to $1\frac{1}{2}$ inches OD.

The principle of operation of the guide pipe-piston assembly is more clearly illustrated in the embodiment of FIG. 2. That is, a fluid seal 54 between the stationary guide pipe and movable piston means is provided so that the high pressure fluid emerging from housing 48 (e.g. at 1,000 to 10,000 psi or higher) applies a high pressure force against drillhead 52 to cause it to move forwardly at a relatively high speed. The pressurized drilling fluid presses against seal 54 and the portion of the guide pipe upstream from that seal which is in fluid communication with the entire length of the tube 50, to assure that the major force is directed against the rearward side of the drillhead to cause it to project forwardly. Although a minor portion of the pressure is lost due to the drilling fluid emerging through ports 52, the major portion of that force carries the drillhead and drilling tube forwardly.

Downstream of seal 54, significant internal radial pressure (hoop pressure) causes the normally rigid piston body tube (e.g. formed of 0.80–0.125 in. wall thickness for steel tubing ranging from $1\frac{3}{8}$ to $1\frac{1}{2}$ inch OD) to be highly stressed. This stress, together with the bending stresses created when the piston tube passes through the whipstock, causes the tube to be plastically deformed and turned or bent in a relatively short radius from a horizontal to a vertical direction.

With the system of FIG. 2 vertical drilling is created without the necessity of a pre-existing casing. However, radials are not formed. Since the pressure behind the seal 54 must be maintained for the above-described mode of propulsion and simultaneously jet cutting (hereinafter the piston effect), it is apparent that the length of the piston body downstream of the seal can be no greater than the initial length of the guide pipe upstream of the seal. One of the major advantages of the illustrated system is that no pre-existing casing is required, and it is unnecessary to drill a pre-existing hole for the guide tube. If desired for a particular application, the guide tube may be axially aligned with the horizontal drilling path of a radial hole.

Referring to FIGS. 3 and 4, one embodiment of the drillhead of the present invention is illustrated. Drillhead 56 is mounted to the forward end of the piston body tube 58, suitably by welding. As illustrated, the forward end of the drillhead is generally rounded, hemispherical in shape. Spaced generally forward directed ports 56*a* are illustrated. In addition, elliptical ports 56*b* may be provided for directing drilling fluid in a generally rearward direction to assist the fluidizing of cuttings surrounding the piston body as it passes through the formation, to lubricate the cuttings and prevent binding with the formation and to assist movement of the formed cuttings in a rearward direction. Alternatively, all ports may be directed forward to maximize cutting.

Referring to FIGS. 5, 6 and 7, another embodiment of a drillhead in accordance with the present invention is illustrated. There, drillhead 60 includes a hemispherical forward shape tapering into a generally cylindrical shape on a nose portion 60*a*. Behind the nose portion is a truncated conical portion 60*b* tapering inwardly in a forward direction so that nose portion 60*a* is formed into a generally flat annular portion 60*c* perpendicular to the axis of tube 62. The entire system is hollow. Forwardly directed jets 60*d* are provided of the same general type as jets 56*a*. Rearwardly directed jets 60*e*, circumferentially spaced on annular portion 60*c*, as shown in FIG. 7, may be provided to serve the same general function as rearwardly directed jets 56*b*.

Referring to FIGS. 8 and 9, in another embodiment of the drillhead, piston body 64 is cut in two different crossing lines at its forward end and folded inwardly to form an ellipsoidal nose portion 64*a*, with forwardly directed jets 64*b* and rearwardly directed jets 64*c* serving the same general function as described above.

Figure 10:
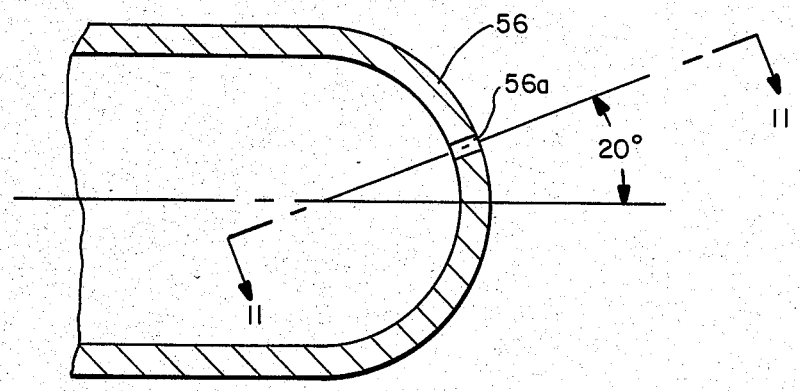
Figure 11:
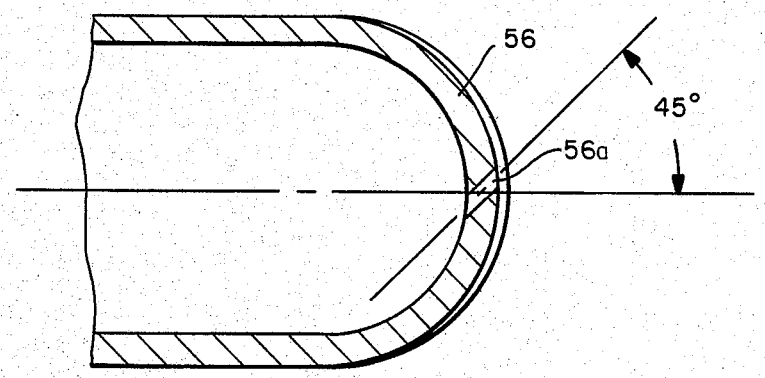
FIG. 11 is a cross-sectional view taken along the line 11—11 of the same opening as in FIG. 10, illustrating the oblique-oblique orientation of one of a number of multiple ports in a drillhead embodiment.

Referring to FIGS. 10 and 11, the nose of the drillhead of FIGS. 3 and 4 is illustrated in which one or more of ports 56*a* are illustrated in an oblique-oblique direction. That is, such port is disposed in a direction which is oblique in two different planes to the axis of the drillhead. In this manner, the jets cut the kerf or slot walls which would otherwise by formed forward of the drillhead by ports oblique in one direction only and cause possible drillhead resistance. By disposing the ports obliquely at least 10°–30° off the axis in at least two different directions, the fluid jet shears the formation in such a manner that the drillhead functions progressively to shear off the kerfs in the cut formation as the drillhead passes.

Figure 12:
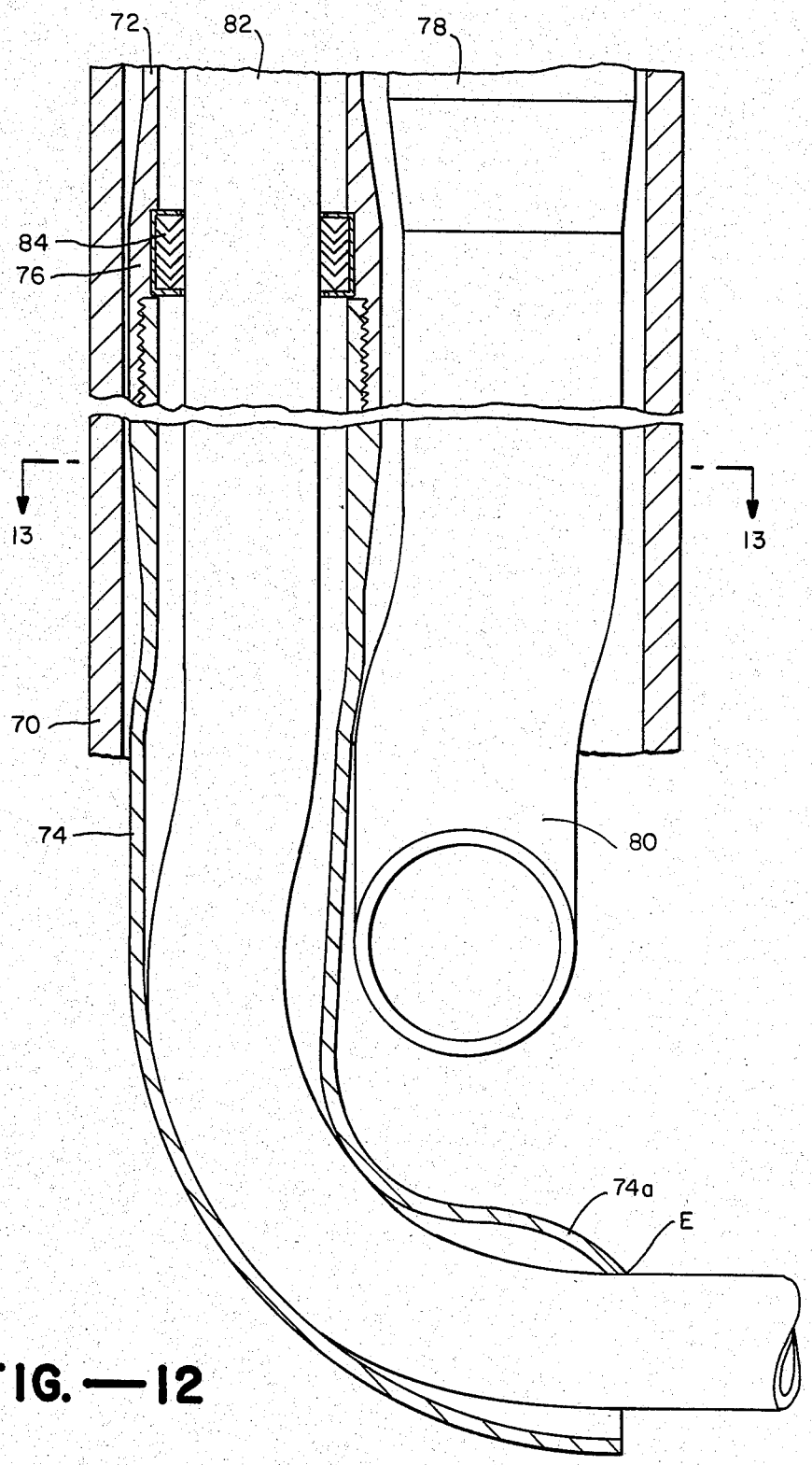
FIG. 12 is a view, partially in section, of a casing with two different whipstocks projecting therefrom, and illustrating one whipstock broken away with a piston body projecting therethrough.
Figure 13:
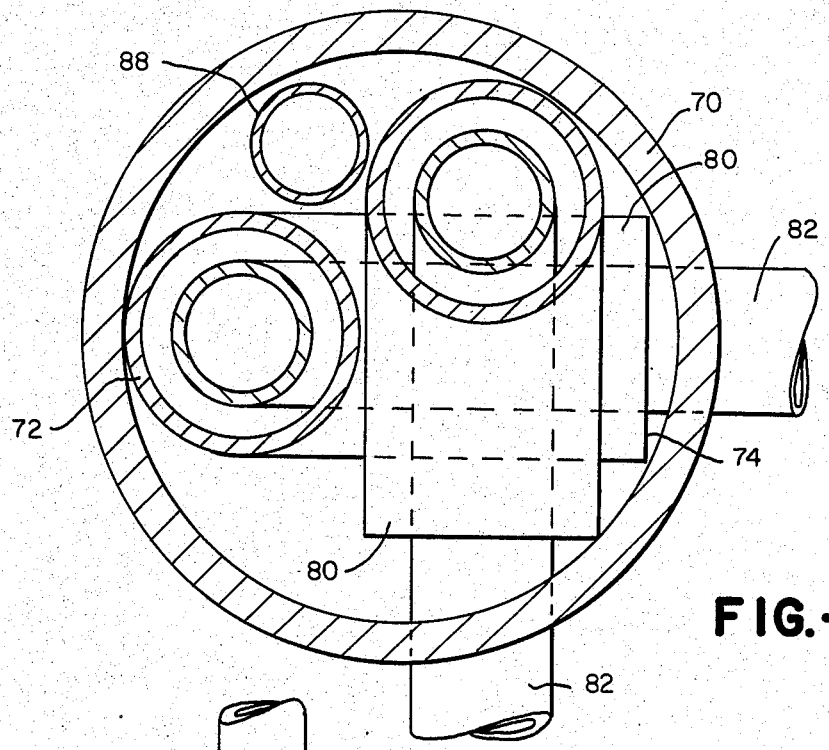
FIG. 13 is a cross-sectional view taken along the line 13—13 of FIG. 12.

Referring to FIGS. 12 and 13, a system is illustrated including two piston-guide tube assemblies disposed in a pre-existing well casing. A typical well casing is 5.5 in. outer diameter, whereas a typical guide tube is formed of segments as described above, such as supplied under the trademark Hydril CS tubing, 2 1/6 in. OD. All components are contained within well casing 70, including a guide tube 72 connected to a curved whipstock 74 at its forward end by a pin-box coupling 76 of the type generally described above. A second guide tube 78 is disposed in casing 70 in axial side-by-side relationship with guide tube 72, and includes a whipstock 80 at its forward end. As illustrated in FIG. 12, a piston body 82 is slidably received in guide tube 72, and turns in the direction illustrated in the whipstock from a generally vertical direction to a generally horizontal direction proceeding to the right-hand side of the figure. A sliding seal is formed for piston body 82 by an annular O-ring seal 84 mounted to the inner wall of guide tube 72, of the type described above. Both the interior and exterior of the piston body or drilling tube are pressurized above the seal, while only the interior of the drilling tube is pressurized below the seal. It has been found that the piston body curves towards the outer radius of the whipstock when in the turn.

Referring to FIG. 13, a second piston body is illustrated projecting from whipstock 80 at 90° to piston body 82. Also, a fluids downcomer pipe 88 is mounted within well casing 70 in an open space thereof. As illustrated, there is a tight fit to utilize the entire space of an existing 5.5 in. OD well casing. Thus, referring to FIG. 2, the couplings 76 in guide tube 72 are offset axially from the couplings of guide tube 78, to provide sufficient space to fit the two radials.

As illustrated, the area not taken up by the two assemblies provides a channel or conduit for fluids, designated the fluids riser area, to permit lifting of cuttings upwardly, if required, to the surface by foam injection through the downcomer or the like.

As further illustrated in FIG. 12, piston body 82 travels downwardly through seal 84 under high fluid pressure exerted against the rear of the drillhead, to provide the piston effect as described above. The piston body tube contacts the arcuate wall of the whipstock and is caused to assume the general shape of the outer radius of the whipstock, as illustrated. Unless prevented, the tube typically will continue along the path of the curve and form a spiral shape.

Thus, whipstock 74 is provided with a downwardly directed tube straightener portion 74*a* at the inner radius of the turn, to contact the piston body at point E to cause it to straighten to a generally horizontal path, as illustrated in FIG. 12. In this figure the seal 84 is located at the entrant or upper portion of the whipstock.

To fit within casing 70, the outer radius of a whipstock can project no further radially than the inner wall of the casing. This constricts the turning radius of the whipstock and, hence, of the piston body. It has been found that 90° turns are more precisely made from a 12 inch or greater turning radius whipstock. Thus, where there is freedom of choice in the diameter of the casing, a sufficient size may be selected to accommodate a sufficiently larger radius whipstock for a smooth 90° turn of the piston body.

In the embodiment of FIGS. 11–13, the radials may extend from an opening in the casing. This may be accomplished as described above, for example by slotting or milling and underreaming the area in which it is desired to turn, or by the use of an abrasive such as silica, iron powder or glass beads in the drilling fluid, which is utilized at the time when the drillhead is adjacent the casing to erode away the casing and any cement, to form a cavity 85 (FIG. 15) through which the body tubes and drilling heads are projected.

Figure 14:
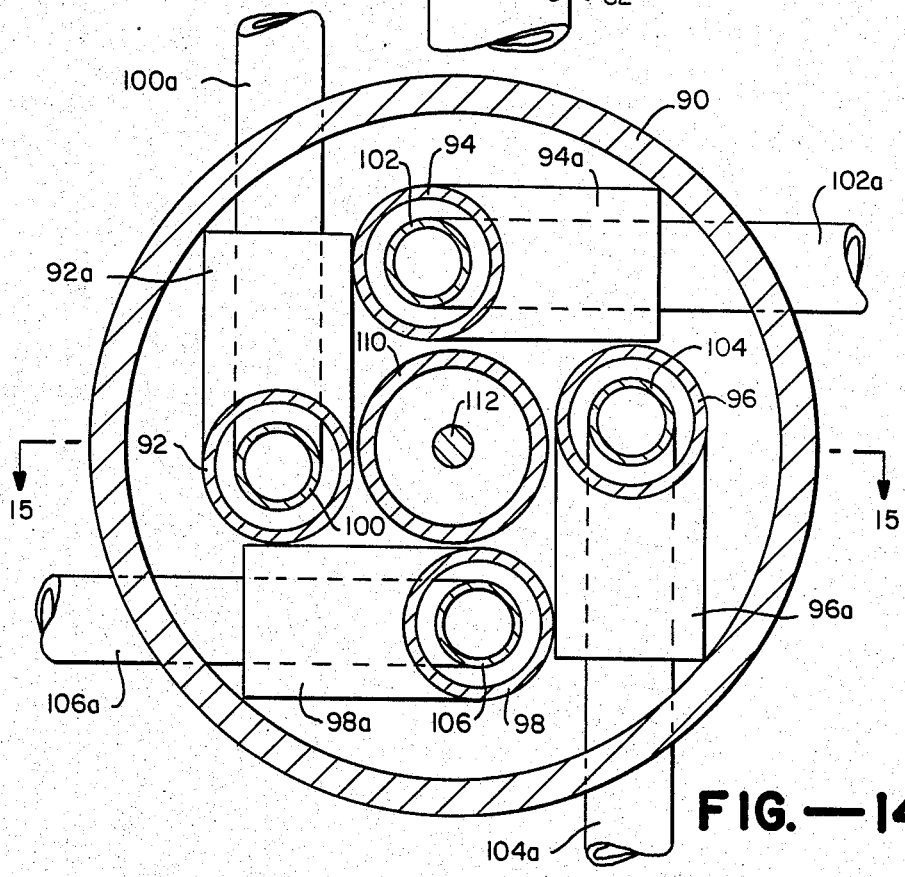
FIG. 14 is a cross-sectional view of a casing including four radials and corresponding whipstocks, together with a central production string.
Figure 15:
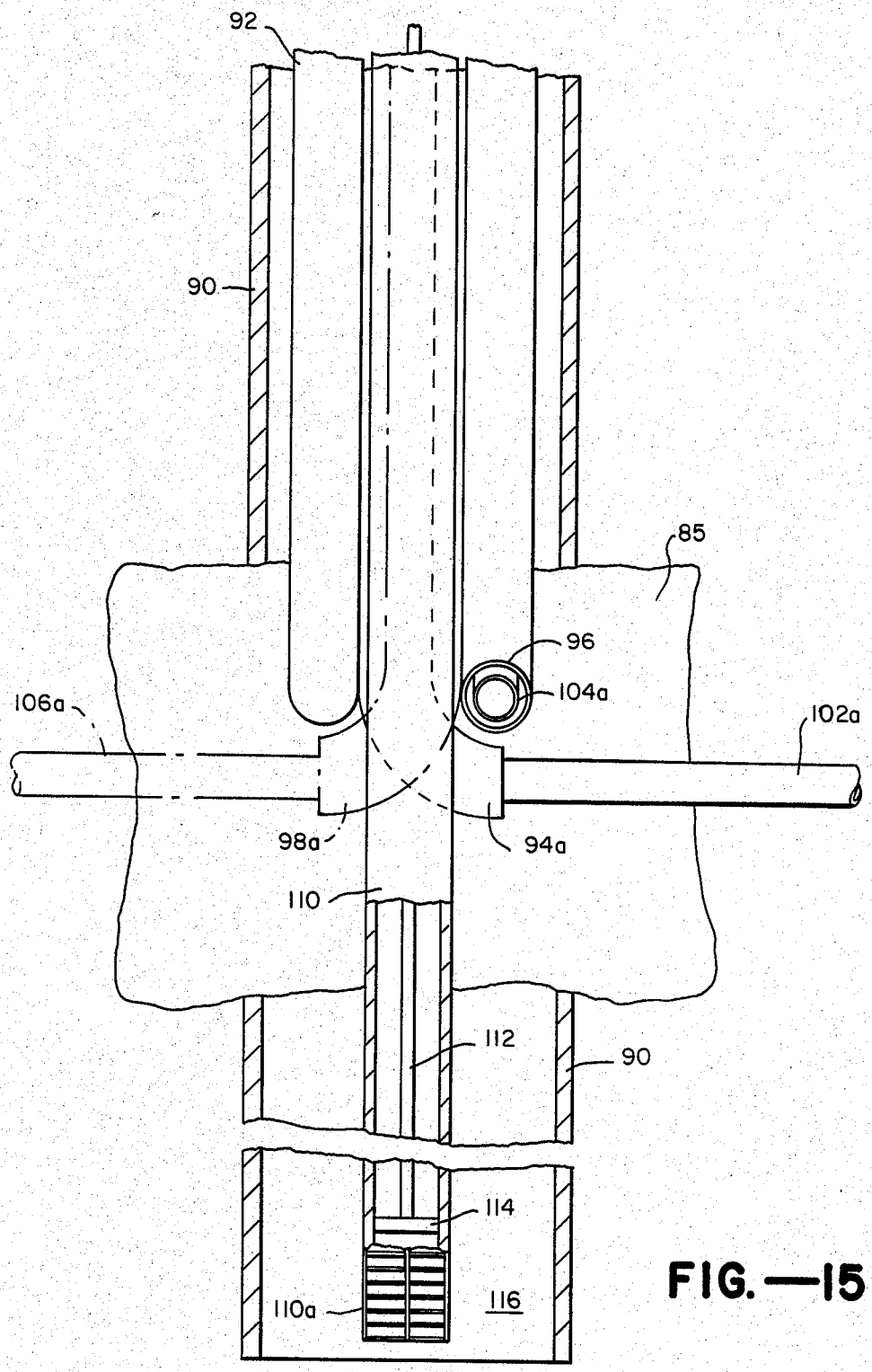
FIG. 15 is a cross-sectional view of the system of FIG. 14 taken along the line 15—15.

Referring to FIGS. 14 and 15, a combination injection well and production well is illustrated. There, a pre-existing well casing 90 is provided, and four guide tubes 92, 94, 96 and 98 ending in whipstocks 92*a*, 94*a*, 96*a* and 98*a*, respectively, are placed circumferentially within the guide tube. Whipstocks 92*a* and 96*a* project parallel to each other in opposite directions. Similarly, whipstocks 94*a* and 98*a* project parallel to each other in opposite directions and perpendicular to the directions of whipstocks 92*a* and 96*a*. Piston bodies 100, 102, 104 and 106 are directed downwardly through guide tubes 92, 94, 96 and 98, respectively, and turn through their respective whipstocks to form horizontal or radial portion 100*a*, 102*a*, 104*a* and 106*a*, respectively. Thus radials project every 90 degrees in a horizontal direction into the formation.

Centrally of the well casing 90 is a production tubing or pipe 110 of a conventional size and shape, including a conventional sucker rod pump assembly with a sucker rod 112 and a piston valve schematically illustrated at 114 in FIG. 15. At the bottom of the tubing 110 is a conventional slotted cylindrical portion 110*a*, which is permeable to oil flow but which filters out particulate matter, such as a wire-wrapped screen sand filter.

In essence, the embodiment of FIGS. 14 and 15 comprises a combination injection production system. That is, after the radials (100*a*, 102*a*, 104*a*, 106*a*) are in place and the bottom of production tubing 110 is in place in a sump at the bottom of casing 90, a hot fluid such as steam may be flowed through the radials and out the drillhead to heat the adjacent oil bearing formation to cause the oil to flow downwardly and into the sump, generally designated by the number 116. There, the oil is pumped to the surface in a conventional manner by a sucker rod pump assembly. Heat energy is used effectively since some of the heat from the downwardly flowing steam is utilized to maintain the upwardly flowing oil at a temperature such that the oil is maintained fluid as delivered to the top of the well.

Figure 16:
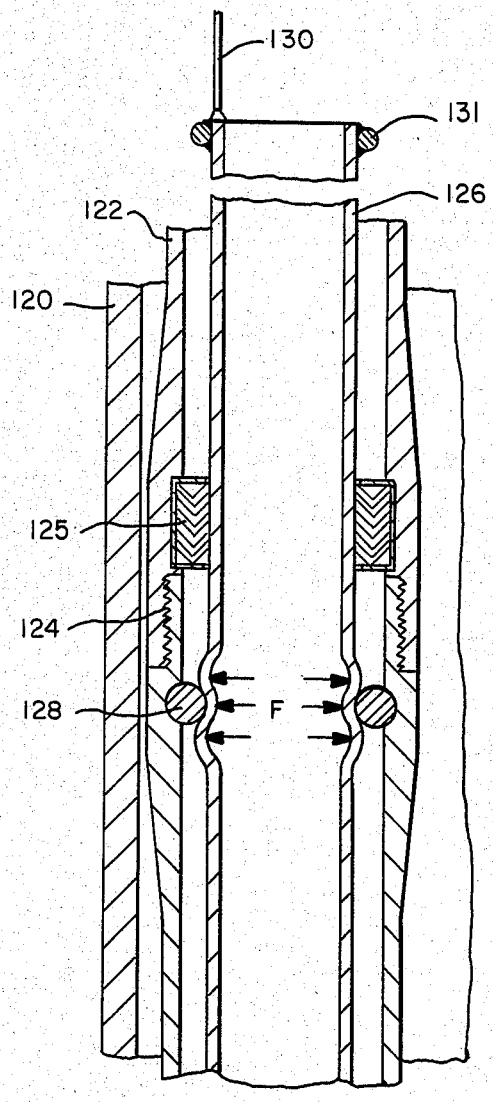
FIG. 16 is a cross-sectional view of a drill casing, guide tube and piston body illustrating one mode of forming a steam seal.

Referring to FIG. 16, a cross-sectional view of a seal between the guide tube and piston body is illustrated subsequent to full projection of the radial portion of the piston body. The sliding seal suitable for accomplishing the driving piston effect may not be sufficiently tight to fully contain steam injection into the piston body for heating the underground formation due to thermal effects. This is the purpose for the second metal/metal steam seal 128.

Referring specifically to FIG. 16, an outer well casing 120 is illustrated. Adjacent sections of a guide tube 122 are coupled at zone 124. In the interior of guide tube 122 is the piston body or drilling tube 126, which slides through seal 125 of the type described above under the force of hydraulic pressure, until the radial portion of the piston body, not shown, projects to its fullest extent. Thereafter, a suitable steam seal is formed. One mode of accomplishing this is to mount a metal O-ring onto the inner wall of guide tube 122. When the radial portion of piston body 126 is fully extended, a force such as an explosive charge is applied in a region of the piston body 126 adjacent to O-ring 128, to cause the piston body to expand and firmly bear against the ring to cause a permanently deformed seal, as illustrated in the area adjacent to the arrows F. Other steam sealing means may also be utilized for this purpose.

It is possible that the force applied to the drillhead is sufficient to cause the piston body to move at a rate faster than the jets can effectively fluidize the formation which the drillhead contacts. Referring again to FIG. 16, means may be provided in the form of a restraint line 130 for controlling the maximum rate of movement of the piston body. Such a line may also serve to monitor the speed with which the drillhead progresses into the formation. The speed of the drillhead into the formation should be such as to cause continuous slurrification in advance of the drillhead for smooth travel of the piston body or tube. The progress of the drillhead may also be monitored by so-called accoustic tracking.

A stop 131 is provided to assure that the piston body maintains sealing contact with seal 125 when the piston body has traveled to its maximum radial distance. As illustrated in FIG. 16, such stop may be in the form of an external ring 131 mounted toward the rearward end of the piston body which causes the piston body to stop on contact with seal 125.

Figure 17:
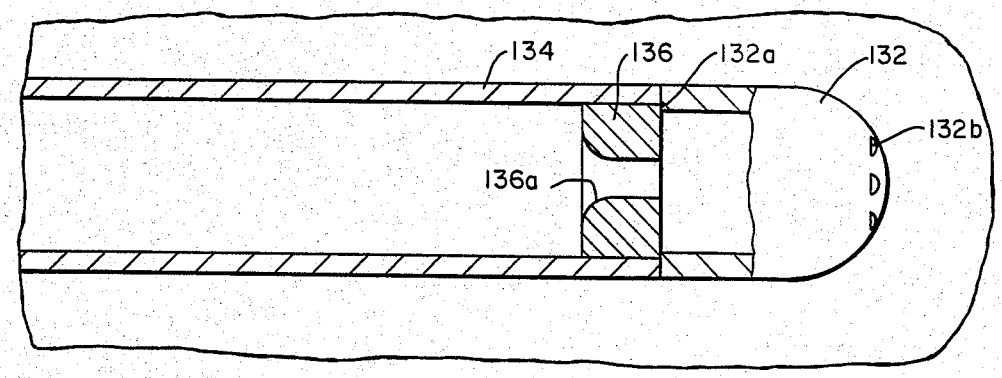
FIG. 17 is a side view, partially in section, of the drillhead of the present invention, including a pressure reduction orifice body.

Referring to FIG. 17, drillhead 132 is illustrated as being mounted on the forward end of piston tube 134. A shoulder 132*a* is provided at the rearward side of the drillhead to seat a steam pressure reduction orifice means in the form of bean or plug 136, defining a tapered central orifice 136*a*. When drilling fluid is passed through the system and out ports 132*b*, it is desirable to have no constriction of the illustrated type. However, when steam is injected, the high pressure of the steam may be sufficient to fracture or frac the surrounding formation, which may be undesirable. On the other hand, a lower pressure would require a higher flow rate, which could erode the pipe. The solution to this problem is to utilize the bean 136, which serves as a choke nozzle. The orifice body (bean) may be propelled downwardly through the system to the illustrated shoulder 132*a* under fluid pressure behind it.

As set forth above, it is noted that a major advantage of the above drilling system is that it is not necessary to employ rotary drilling in order to drill the formation. This is a significant saving in operating costs and durability of the system. Also, the radial position of the piston body tube serves as a duct for treating fluid (e.g. steam) after it has been used for drilling.

A system of the foregoing type may be utilized for the injection of a hot fluid or steam through the radials which are formed in the system for heating the underground formation for production at either the same casing as the one from which the radials project, or at a remote casing. One of the advantages in a combination production injection well is that the oil flows backwardly through the heated area to take full advantage of the injected steam.

A specific example of drilling in accordance with the present invention is as follows. The guide pipe terminating in a whipstock is placed in a pre-existing well casing together with an internal steel piston tube (e.g. 1¼ inch OD). Then high pressured drilling fluid introduced into the guide pipe from the surface drives the drillhead at the forward end of the piston and the body tube downwardly and through the whipstock to bend and restraighten the body tube (e.g. 0.080–0.125 in. wall thickness) and cause it to turn in a horizontal direction. Suitable drilling fluid pressures are on the order of 1,000 to 10,000 psi or more. The drilling fluid not only drives the drillhead forwardly, but also jets through ports in the drillhead into the adjacent underground formation to form cuttings and produce a bore hole. The production of cuttings is accompanied by radial progression of the drillhead. Suitable diameter sizes for the openings in the drillhead are 0.032 in. to 0.125 in., and during steam injection are 0.063 in. or larger. If sufficient pressure is applied, the underground formation may frac or fracture, and no cuttings may be returned back along the external perimeter of the lateral portion of the piston body. Alternatively, the cuttings may move backwardly along the wall and into a sump formed below the whipstock. Lifting fluids from a downcomer serve to lift the fluids up to the surface, or such fluids can be removed by suitable pumping means.

When drilling is complete, the system is sealed as illustrated in FIG. 16 or by some other means. For example, the system may be sealed by passing cement into the area surrounding the piston body through the fluids downcomer or guide tube. If the openings in the drillhead are of insufficient size to pass the necessary volumes of steam or other fluid, an abrasive may be included in the drilling fluid to erode out the openings to the desired size for fluid injection, or the openings may be enlarged by the action of a suitable solvent.

It is apparent from the foregoing that a simple, economical system and method has been provided for forming one or more radials suitable for fluid injection into an underground formation, which is a substantial improvement over prior art methods. In addition, the system lends itself to a combination injection production well.

Figure 18:
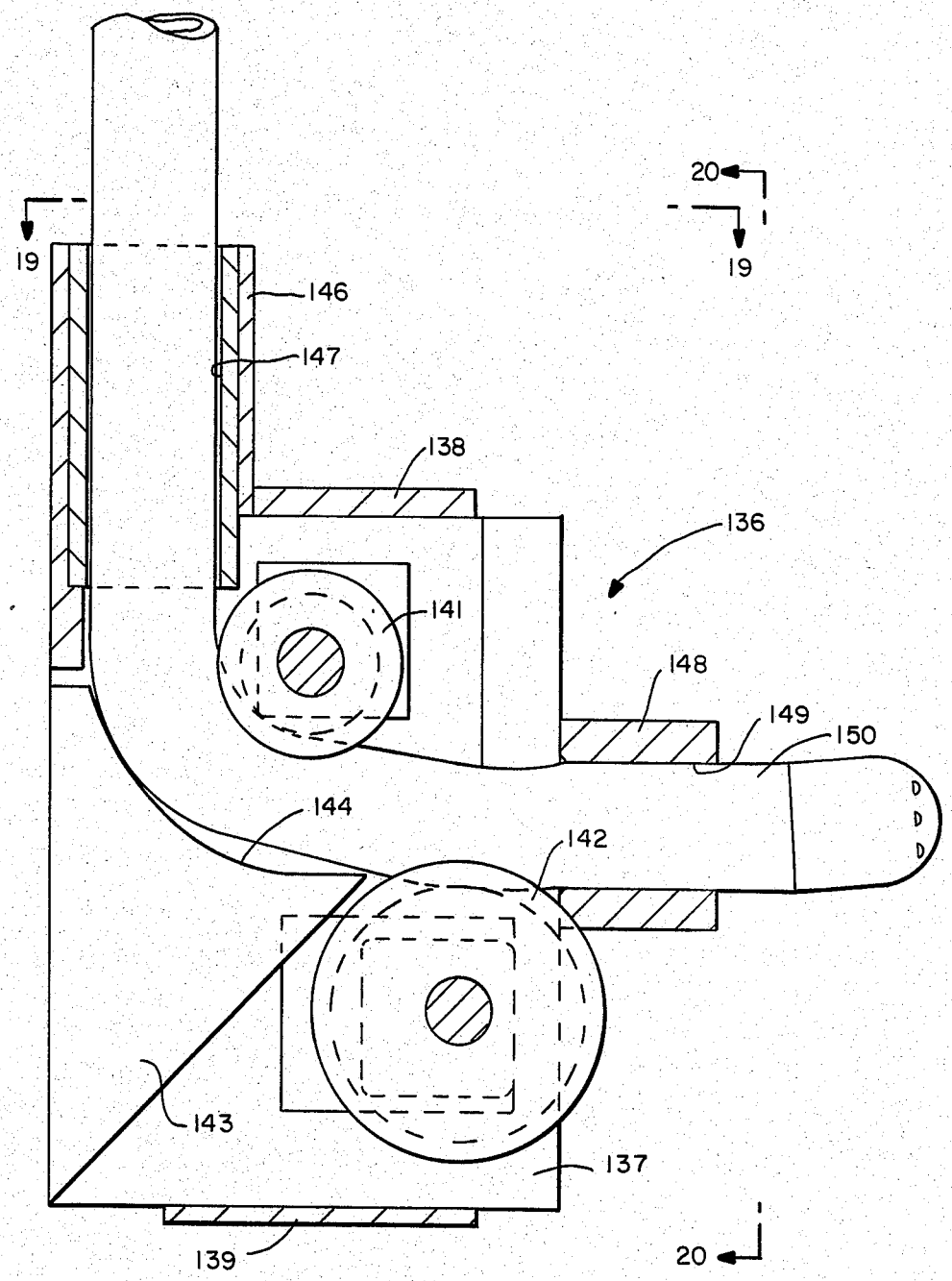
FIG. 18 is a view in side elevation showing another embodiment of bending means.
Figure 19:
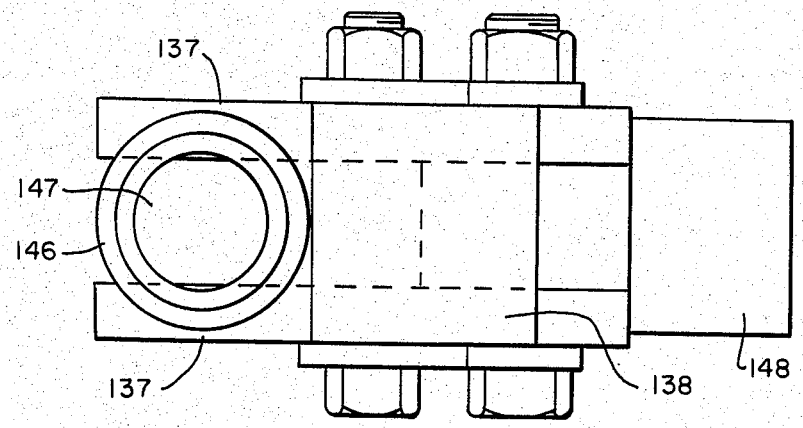
FIG. 19 is a view taken as indicated by line 19—19 of FIG. 18.
Figure 20:
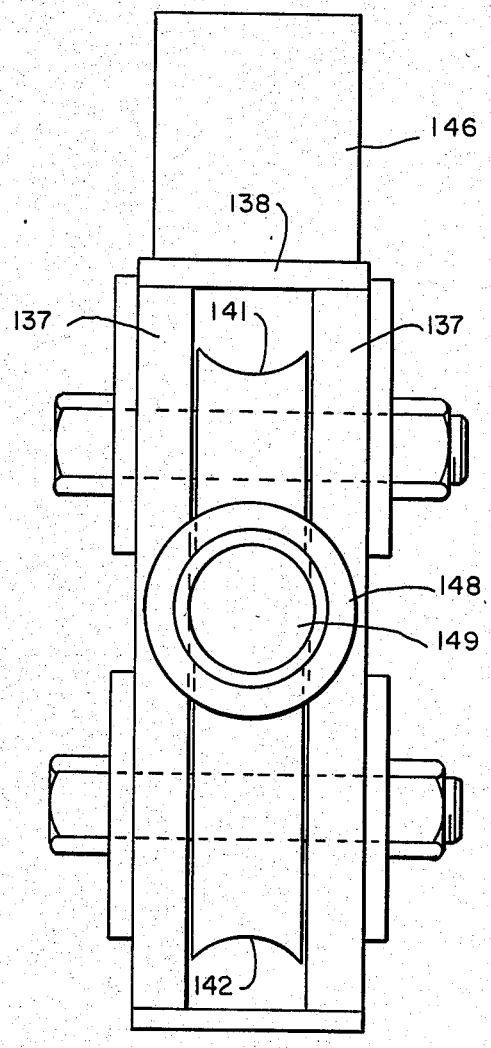
FIG. 20 is a view taken as indicated by line 20—20 of FIG. 18.

Another embodiment of the whipstock or drilling tube bending means is shown in FIGS. 18–20. It consists of a rigid box-like body 136, constructed of rigid side plates 137, connected by the upper and lower end plates 138 and 139. Sheaves 141 and 142 are journaled between the side plates, and a block 143 disposed between the plates, is provided with a curved surface 144. The upper portion 146 is adapted to be attached to the lower end of guide tube 30 as shown in FIG. 1. The passage 147 through part 146 has a diameter sufficient to pass the drilling tube and head. One side of the body 136 is provided with the extension 148, which provides a passage 149 only slightly larger in diameter than the normal diameter of the drilling tube and head. When the piston means is driven downwardly through the passage 147 by hydraulic pressure, the drilling tube 150 is bent laterally by engaging and passing over the curved surface 144, and from thence it passes through the extension 148, which together with sheave 142 performs the function of straightening the drilling tube. Sheave 141 assists in retaining the tube in proper relation with the curved surface 144, and the tube rides over the sheave 142 immediately before proceeding through the tube straightening means.

Figure 21:
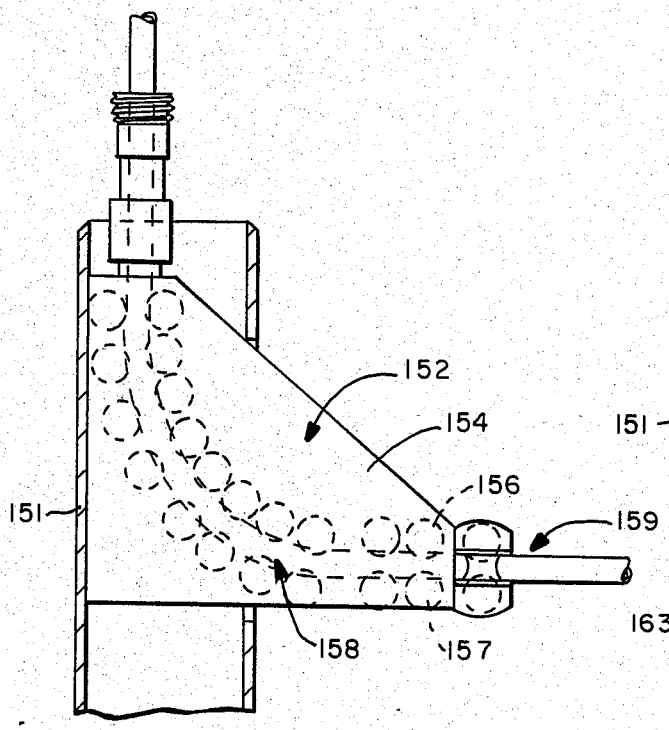
FIG. 21 is a detail in side elevation showing another embodiment of tube bending means.
Figure 22:
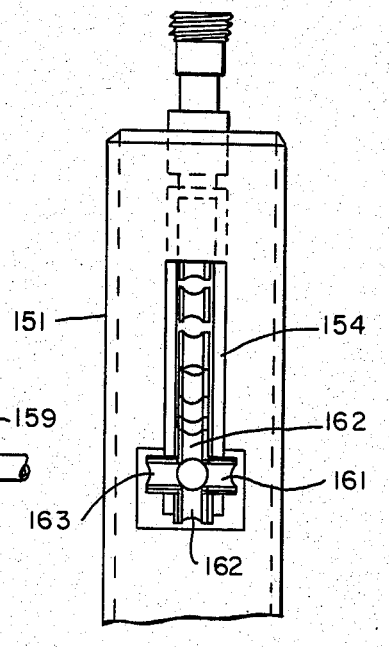
FIG. 22 is a view looking toward the exit end of the guide way of the bending and straightening means of FIG. 21.

Two additional embodiments of tube bending means are illustrated in FIGS. 21–24. In both instances the dimensions and configurations are such that the well must be of sufficient diameter to permit their introduction. In FIG. 21 a housing 151 encloses a portion of tube bending means 152. The bending means consists of a body which is rigid, and is formed by the spaced side plates 154 that are secured together by connecting walls. Two series of sheaves 156 and 157 are journaled between the side walls 154, and are positioned to form the curved guide way 158. This guide way is dimensioned to be compatible with movement of the drilling tube through the same, the arrangement being such that when the drilling head and tube are forced through the guide way by hydraulic pressure, the tube is at all times in contact with a plurality of sheaves, and is bent to the desired radii. Tube straightening means 159 is disposed at the exit end of the guide way, and consists of a cruciform-like body 161, which is attached to the side plates 154. The body carries four sheaves, namely the upper and lower sheaves 162, and the opposed side sheaves 163. These sheaves are so formed that their peripheral surfaces embrace substantially the entire circumference of the drilling tube.

Figure 23:
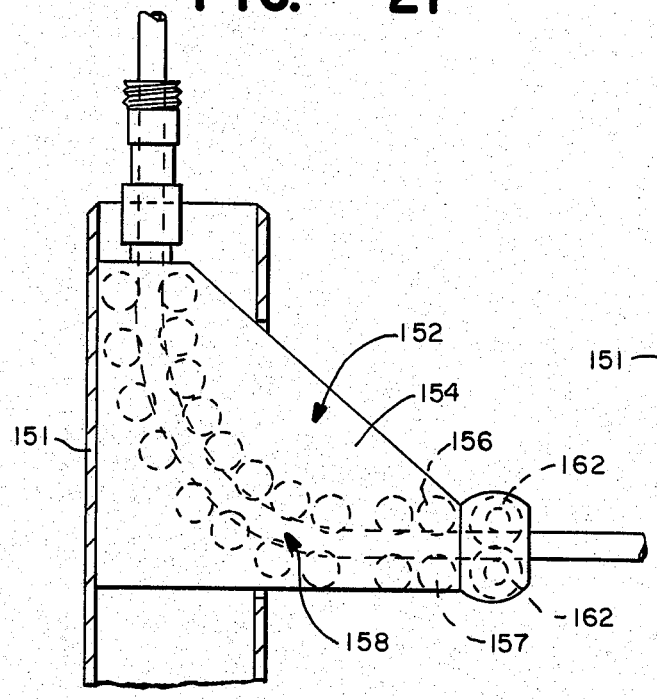
FIG. 23 is a detail in side elevation showing another embodiment of tube bending and straightening means.
Figure 24:
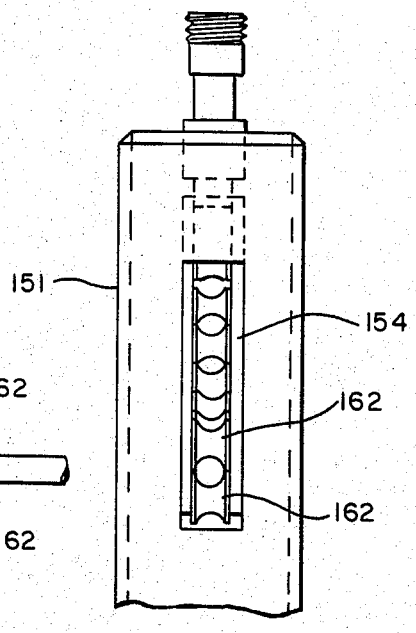
FIG. 24 is a detail looking toward the exit end of the guide way of FIG. 23.

It may be explained that when the drilling tube is caused to pass through the guide way 158 the bending is accompanied by some change in its cross-sectional configuration. More specifically as the tube reaches the end of the guide way it has a cross-section configuration which is oval rather than circular. It has been found that straightening of such a tube is more effective if it includes some reforming of the tube to circular configuration. To accomplish this the sheaves 163 are so formed that they apply force to the exiting drilling tube to somewhat reform the same to circular configuration while simultaneously applying unbending force. In connection with the straightening action the sheaves 162 and 63 also cooperate with the adjacent ones of sheaves 156 and 157. In some instances it may not be necessary to use the cruciform type of straightening means shown in FIGS. 21 and 22. Thus as shown in FIGS. 23 and 24 the straightening means in such event can employ only the two upper and lower sheaves 162.

Figure 25:
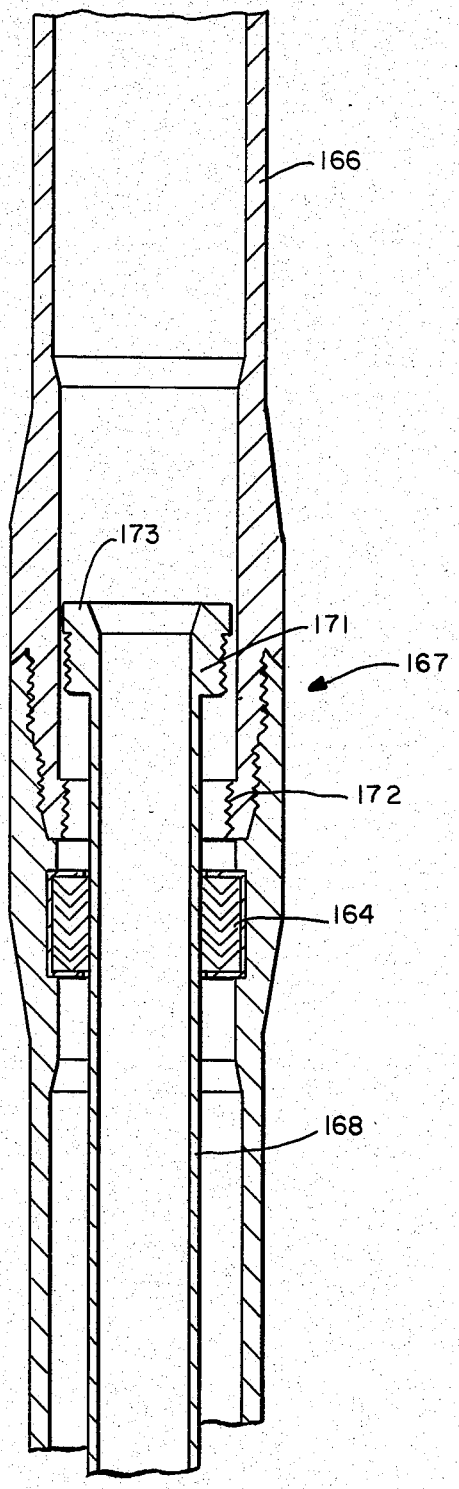
FIG. 25 is a detail in side elevation and in section showing means for establishing a sealed connection for introducing steam or other treated fluid into the drilling tube.
Figure 26:
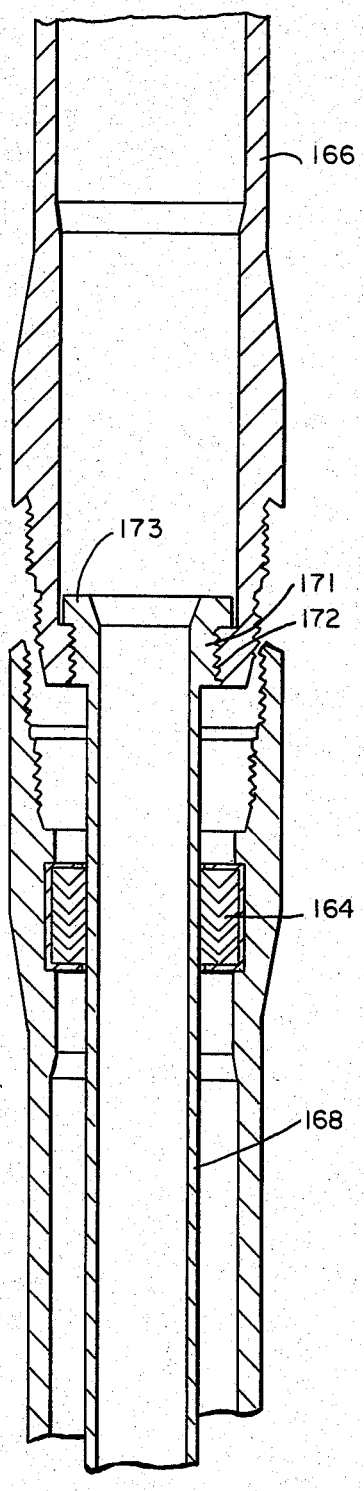
FIG. 26 is like FIG. 25 but shows a connection after it is established for introducing steam or other treated fluid.

Previous reference has been made to introduction of fluids such as steam into the drilling tube, after the drilling head has been caused to form a bore into the mineral bearing formation. FIGS. 25 and 26 show a guide pipe 166 together with a threaded coupling 167 between sections of the guide pipe. The drilling tube 168 is shown passing through the seal 169. The upper end of the drilling tube 168 is provided with the threaded portion 171. The lower end of the upper section of the guide pipe 166, is also provided with the internally threaded portion 172. The threads of the coupling 167 are made the same as the threads of the collar 171 and portion 172. More specifically the threads for coupling the two sections of the guide pipe may be left-handed, and the threads of 171 and 172 are also made left-handed. Assuming that hydraulic pressure has been applied to the guide pipe to force the drilling tube 168 and its attached drilling head laterally into the mineral bearing formation and it is now desired to introduce steam or other treatment fluid into the drilling tube, the coupling 167 is disengaged by clockwise turning the upper part of the guide pipe 166, after which it is lifted and turned counterclockwise to engage the threaded portions 171 and 172. This provides a sealed metal to metal coupling. The parts are then in the condition shown in FIG. 26. Steam or other treatment fluid can now be introduced through the guide pipe and through the drilling tube 168, and from thence into the mineral bearing formation.

FIGS. 25 and 26 also show an annular portion 173 at the inlet to the portion 171, which is formed to provide a downwardly convergent entrant opening. This improves the flow characteristics of the arrangement in that it provides a transition from the larger internal diameter of pipe 166 to the smaller internal diameter of tube 168. Portion 173 is dimensioned to form a stop when the threaded portions 171 and 172 are engaged.

What is claimed is:

1. An apparatus for forming a bore hole in an underground mineral bearing formation, comprising at least one assembly guide means including a guide pipe and piston means movable in the guide pipe, said guide pipe having a forward end and a rearward end and a sealing means therein, said piston means being adapted to move within said guide pipe in fluid sealing engagement with the sealing means, said piston means including an elongate piston body forming a drilling tube having a solid rigid wall and defining an interior fluid passageway, a drillhead of the hydraulic jet type on the forward end of the drilling tube, said sealing means being disposed between the guide pipe and drilling pipe and being mounted to the interior surface of said guide pipe and having fluid sealing engagement with said drilling tube, said guide pipe being in open fluid communication with the rearward side of the drillhead, the drillhead having a fluid pressure area on its rearward side transverse to the fluid passageway capable of receiving fluid pressure so that pressurized hydraulic fluid applied to the guide pipe and from thence into the drilling tube applies pressure against said drillhead rearward side to cause said piston means to move in a forward direction.

2. An apparatus for forming a bore hole in an underground mineral bearing formation, comprising at least one assembly guide means including a guide pipe and piston means movable in the guide pipe, said guide pipe having a forward end and a rearward end and a sealing means therein, said piston means being adapted to move within said guide pipe in fluid sealing engagement with the sealing means, said piston means including an elongate piston body forming a drilling tube having a solid rigid wall and defining an interior fluid passageway, a drillhead of the hydraulic jet type on the forward end of the drilling tube, said drillhead means being free of means to impart rotational movement to it, said sealing means being disposed between the guide pipe and drilling pipe, said guide pipe being in open fluid communication with the rearward side of the drillhead, the drillhead having a fluid pressure area on its rearward side transverse to the fluid passageway capable of receiving fluid pressure so that pressurized hydraulic fluid applied to the guide pipe and from thence into the drilling tube applies pressure against said drillhead rearward side to cause said piston means to move in a forward direction.

3. The apparatus of claims 1 or 2 in which at least the drillhead and the forward portion of said drilling tube projects from said guide pipe into said underground formation so that said forward portion is surrounded by the underground formation.

4. The apparatus of claims 1 or 2 together with means for supplying pressurized drilling fluid sealing engagement with said drilling tube.

5. The apparatus of claims 1 or 2 together with means capable of forming a communicating connection between said guide pipe and said drilling tube.

6. The apparatus of claims 1 or 2 together with whipstock means adjacent the forward end of said guide pipe to cause said drilling to turn at a substantial angle to the axis of said guide pipe when said drilling tube is moved through the same.

7. The apparatus of claim 6 in which said drilling tube wall is formed of metal of sufficient rigidity to be capable of moving in a substantially straight line through the formation and being capable of plastic deformation.

8. The apparatus of claim 6 together with at least a second guide pipe, whipstock means and piston means assembly disposed in said well casing, the guide pipes of said assemblies being aligned in the well and the whipstock means being in proximity with each other.

9. Apparatus as in claim 6 in which the whipstock means comprises means forming a curved guide way through which the tube is forced when pressurized hydraulic fluid is applied to the guide tube, said whipstock guide way including rotatable rollers or sheaves disposed to engage and apply forces to the drilling tube to bend the same.

10. Apparatus as in claim 9 in which a part of the curved guide way is formed by a stationary member having a curved concave surface engaged by the tube during movement of the tube through the guide way.

11. Apparatus as in claim 6 in which the guide way of the whipstock is formed by a series of rotatable rollers or sheaves that are disposed to engaged both the inner and outer surfaces of the tube bend.

12. Apparatus as in claims 9 or 11 in which the whipstock means includes tube straightening means disposed adjacent the exit end of the guide way.

13. The apparatus of claims 1 or 2 in which said one assembly is disposed within a well casing which projects into the region of the underground formation.

14. The apparatus of claim 13 together with a downcomer pipe aligned with said one assembly and mounted in said well casing.

15. The apparatus of claims 1 or 2 together with restraint means operatively associated with said piston means for controlling the maximum rate of movement thereof relative to the guide means.

16. The apparatus of claims 1 or 2 in which said piston body comprises a tube suitable for the injection of hot fluid into the formation.

17. The apparatus of claims 1 or 2 in which said drillhead has multiple ports and at least one of the ports of said drillhead extends in a direction which is oblique in two different planes to the axis of the piston means.

18. The apparatus of claims 1 or 2 together with rearwardly directed ports in said drillhead.

19. The apparatus of claims 1 or 2 in which said drillhead includes at least one port which directs fluid in a forward direction.

20. The apparatus of claims 1 or 2 in which said fluid pressure area is sufficient that the major force of the pressurized hydraulic fluid is applied against said drillhead rearward side.

21. The method of claims 1 or 2 in which said drilling tube moves forward into said formation in a substantially straight path.

22. Injection apparatus for injecting a treating fluid from a downwardly directed bore hole radially into an underground formation, said injection apparatus being in place in the underground formation and including an assembly comprising an elongate downwardly directed guide pipe having a sealing means mounted therein and terminating at its forward end in a whipstock, a rigid tube having a head at its forward end and being open at its rearward end, the head having multiple fluid exit ports, the rearward portion of said tube being retained in fluid sealing engagement with said sealing means within said guide pipe to define a fluid passageway extending from the rearward end of said guide pipe through said tube to said head, said tube including a forward portion projecting radially from said whipstock into said formation, and including a central plastically deformed portion in said whipstock, whereby treating fluid supplied to the rearward end of said guide pipe flows through said head ports into said formation.

23. The injection apparatus of claim 22 in which said radial tube portion projects in a substantially horizontal direction into said formation.

24. The apparatus of claim 22 in which said radial tube portion is formed of a normally rigid metal and the radially directed portion has a physical metallurgical history of passage through said whipstock portion in a plastically deformed state.

25. The apparatus of claim 22 together with means for supplying pressurized heated fluid into the rearward end of said guide pipe.

26. The apparatus of claim 22 together with steam sealing means between said guide pipe and said tube.

27. The apparatus of claim 22 in which said head is free of means to impart rotational movement to it.

28. The apparatus of claim 22 in which said one assembly is disposed within a well casing which extends into a region adjacent the underground formation.

29. The apparatus of claim 28 together with at least a second assembly disposed within said well casing, the guide pipe of said second assembly being aligned with said one assembly and at one side thereof, and the whipstocks of the two assemblies being in proximity with each other.

30. The apparatus of claim 28 together with a downcomer pipe aligned with said one assembly in said well casing.

31. The apparatus of claim 28 together with production pipe means and an operably associated pump disposed within said well casing.

32. The apparatus of claim 22 together with steam pressure reduction means disposed within said drillhead means.

33. The apparatus of claim 32 together with means for controlling the rate of forward movement of the drillhead.

34. Apparatus as in claim 22 in which the guide pipe includes threaded couplings, the seal being disposed within one of the couplings, the upper rearward end of the drilling tube after movement of the same in a forward direction being located above and adjacent to the sealing means, the pipe section above the one coupling having threads on its internal lower end, and means forming external threads on the upper end of the drilling tube, the last mentioned internal threads and external threads being formed to have threaded engagement when said one coupling has been uncoupled.

35. Apparatus as in claim 22 in which the sealing means is located at the entrant end of the whipstock.

36. A method for forming a bore hole in an underground mineral bearing formation, using a drilling system comprising a guide pipe and a rigid drilling tube within the guide pipe, said drilling tube having a drillhead of the hydraulic jet type, said drillhead having a rearward side of its forward end, said method comprising the steps of:

(a) disposing said drilling tube within the guide pipe with the drillhead in communication with the guide pipe, with a seal between the drilling tube and the guide tube;

(b) directing a hydraulic fluid under pressure into the guide pipe and from thence into the drilling tube to cause said fluid to apply force against the drillhead rearward side to move the drillhead and drilling tube forward a sufficient distance into the formation so that the forward portion of the drilling tube projects from the guide tube into the formation and is surrounded by the formation.

37. The method of claim 36 in which said drillhead does not rotate to any significant extent as said drilling fluid passes through said ports.

38. The method of claim 37 in which drilling fluid is directed through at least one port of the drillhead in a direction which is oblique in two different planes to the axis of the piston means.

39. The method of claim 37 including the step of bending the drilling tube to direct it laterally toward the adjacent formation.

40. The method of claim 39 in which said drilling tube is formed with solid walls of a normally rigid metal which is plastically deformed as it changes direction.

41. The method of claim 39 in which said drilling fluid is pressurized to at least 1000 psi.

42. The method of claim 39 in which said guide pipe is disposed within a well casing, together with the step of directing a pressurized abrasive fluid out said drillhead as it turns through said whipstock to erode an opening in said well casing.

43. The method of claim 39 in which said guide pipe is generally vertical and said direction change is to the generally horizontal plane.

44. The method of claim 39 together with the steps of discontinuing the flow of drilling fluid through the drilling tube after completion of a drilling operation, and then applying a treating fluid into the formation through the tube.

45. The method of claim 44 in which the guide pipe is coupled to the drilling tube and the treating fluid introduced into the guide pipe.

46. The method as in claim 45 in which the treating fluid is steam.

47. A method as in claim 46 in which the formation is of the oil bearing type.

48. The method of claim 36 in which said guide pipe is placed into an existing well casing prior to step (b).

49. The method of claim 48 in which the major force of said hydraulic fluid is applied against the drillhead rearward side.

50. The method of claim 36 together with the step of controlling the rate of forward movement of said drilling tube into the formation.

51. The method of claim 36 together with the step of forming a steam seal between said guide pipe and said drilling tube after step (b).

52. The method of claim 36 together with the step of fluid pressure pumping a pressure reducing orifice body with a pressure reduction opening to seat it behind the drillhead.

53. The method of claim 36 together with the step of pumping at least a portion of said drilling fluid through rearwardly directed ports in said drillhead.

54. A method as in claim 36 in which the guide pipe is in metal sections joined by threaded couplings, the steps of disengaging the coupling between two upper and lower sections that are adjacent said seal and then establishing metal to metal threaded engagement of the lower end of the upper guide pipe section with the upper open end of the drilling tube, whereby the guide pipe is then directly connected with the drilling tube.

55. An apparatus for forming a bore hole in an underground formation, a guide pipe having a fluid seal mounted thereto and adapted to be coupled at one end thereof to a source of fluid under pressure; a rigid tube in the guide pipe in sealing engagement with said seal, said tube being movable through the guide pipe and outwardly thereof through the opposite end of the guide pipe, one end of the tube being open and in fluid communication with the guide pipe; and means on the opposite end of the tube for forming a surface against which fluid under pressure can be directed to cause a fluid force to be exerted on the tube to move it relative to the guide pipe and through said seal; said surface forming means comprising a drillhead having a plurality of fluid exit ports therethrough at least one of which is axially directed.

56. An apparatus as set forth in claim 55, wherein the inner face of said drillhead forms said surface against which fluid can be directed.

57. An apparatus as set forth in claim 56, wherein said drillhead has a plurality of fluid exit ports therethrough at least one of which is generally axially disposed.

58. An apparatus as set forth in claim 59, wherein said seal is annular.

59. An apparatus as set forth in claim 55, wherein the seal engages the tube between the ends thereof.

60. An apparatus as set forth in claim 55, wherein said rigid tube is formed from a material capable of being plastically deformed, the apparatus including a whipstock coupled to the guide pipe near said one end thereof, said tube being movable through the whipstock and adapted to be deformed thereby to cause a bending of the tube in a direction transverse to the longitudinal axis of the guide pipe.

61. The method of claim 55 in which said surface is such that the major force of the fluid under pressure is directed against it.

* * * * *